United States Patent [19]

Gassner et al.

[11] Patent Number: 4,554,861

[45] Date of Patent: Nov. 26, 1985

[54] PNEUMATIC NAILER

[75] Inventors: Theo Gassner, Triesenberg, Liechtenstein; Bruno Hann, Nenzing, Austria; Edwin Kindle, Triesen, Liechtenstein

[73] Assignee: Hilti Aktiengesellschaft, Schaan, Liechtenstein

[21] Appl. No.: 516,139

[22] Filed: Jul. 21, 1983

[30] Foreign Application Priority Data

Jul. 26, 1982 [DE] Fed. Rep. of Germany ..... 3227855

[51] Int. Cl.[4] ..... F15B 13/042

[52] U.S. Cl. ..... 91/446; 91/403; 91/410; 91/448; 91/461

[58] Field of Search ..... 91/308, 446, 410, 403, 91/448, 461; 227/130

[56] References Cited

U.S. PATENT DOCUMENTS 3,552,270 1/1971 Lange ..... 91/308

3,683,746 8/1972 Ramspeck ..... 91/399

3,850,079 11/1974 Fehrs ..... 91/308

*Primary Examiner*—Paul E. Maslousky

*Attorney, Agent, or Firm*—Toren, McGeady, Stanger, Goldberg & Kiel

[57] ABSTRACT

In a pneumatic nailer using compressed air for driving nails, a work chamber contains a drive piston and is in communication with a storage chamber for effecting the return of the drive piston after it has driven a nail. A valve unit controls the supply of additional compressed air into the storage chamber. A switching element is arranged to react when a predetermined compressed air pressure is exceeded for controlling the flow of compressed air through the valve unit to the storage chamber. The switching element can be a pressure limiting valve. The combination of the switching element and valve unit avoids unnecessary compressed air losses in the higher pressure operating ranges.

5 Claims, 1 Drawing Figure

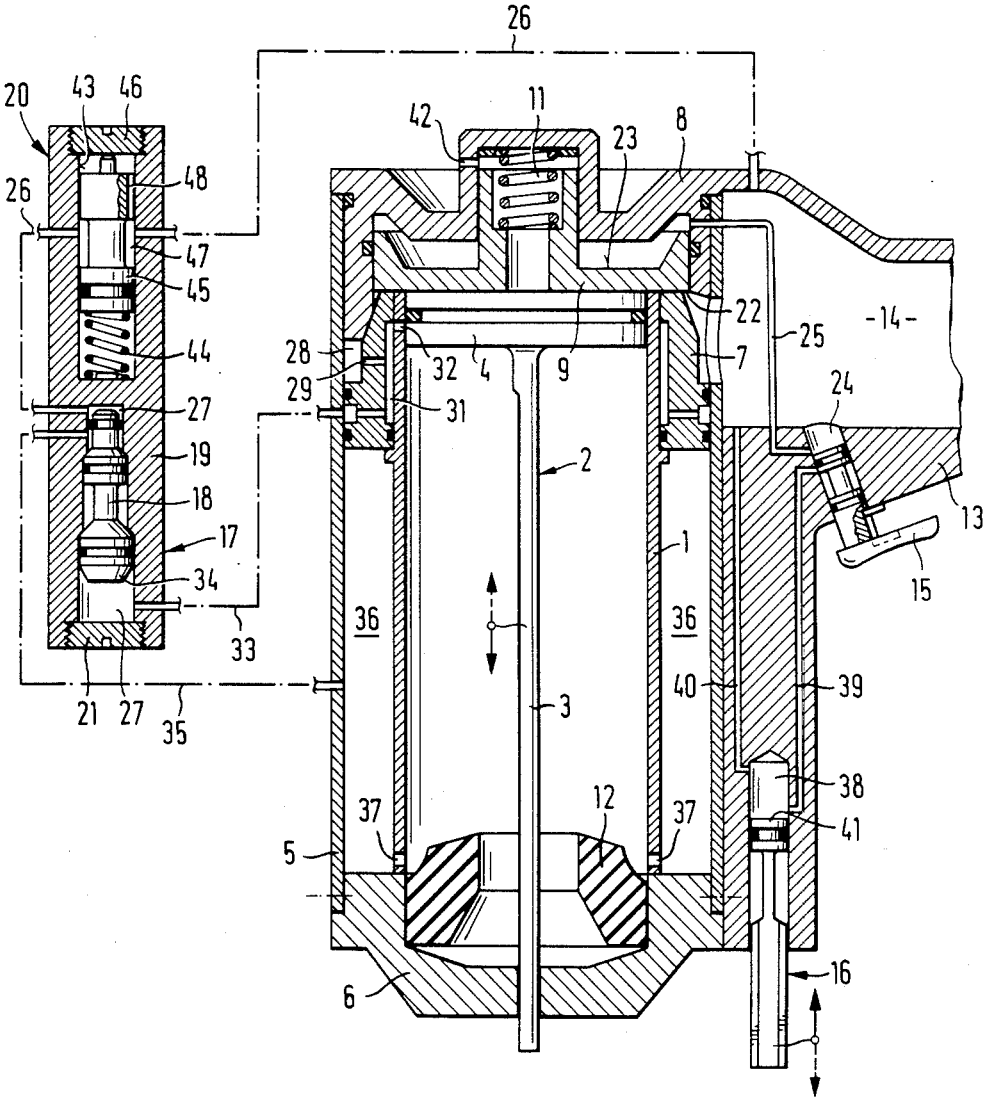
26
20
43
46
48
26
47
45
44
27
19
18
17
34
33
21
27
35
42
11
23
8
22
25
-14-
28
29
32
4
9
7
24
31
2
13
1
15
36
36
40
39
3
38
37
12
37
41
5
16
6

PNEUMATIC NAILER

SUMMARY OF THE INVENTION

The present invention is directed to a pneumatic nailer using compressed air for driving nails. A driving piston for driving the nails is supported in a working cylinder and a storage chamber communicates with the working cylinder through at least one opening in the end region of the working cylinder toward which the drive piston moves during the driving action. When the drive piston moves in the driving direction the air ahead of the piston flows through the opening into the storage chamber. A valve unit is connected to the storage chamber for controlling the supply of compressed air into that chamber.

In known pneumatic nailers there are a variety of systems for the return of the drive piston into the position ready to drive a nail. In one such known tool, the air displaced by the drive piston, as it moves in the driving direction, is allowed to escape to the ambient atmosphere. When the drive piston has reached its end position at the completion of the driving action, the outflow openings are closed and the drive piston is returned to its starting position by means of compressed air. This solution results in a very high consumption of compressed air, since for each complete driving cycle the amount of compressed air required is equal to double the stroke volume.

It is also known to guide the air, displaced by the drive piston, into a storage chamber. The air guided into the storage chamber is compresed by the piston. When the drive piston is no longer pressurized or driven by the compressed air acting on its trailing face, the compressed air cushion in the storage chamber can expand and acting on the leading face of the piston, return it to its starting position. This solution, however, functions satisfactorily only at relatively high operating pressures. If the operating pressure is too low, that is in the range of 3 to 5 bar, the drive piston is returned only partially or the return takes too long so that the complete cycle time is long and the number of nails driven per unit of time is low. For tools operated at a low pressure it is known to support the air cushion in the storage chamber with additional compressed air. In such an operation, however, losses of compressed air occur. Therefore, the tools that have been in use up to the present time have only been suitable for operation over a narrow pressure range. For different pressure ranges it has been necessary to provide different tool designs.

Accordingly, it is the primary object of the present invention to provide a pneumatic nailer suitable for use over a wide pressure range without any unnecessary compressed air losses and, in particular, a nailer which permits a high number of nails to be driven for a given unit of time even at low operating pressure.

In accordance with the present invention, the desired operation of the nailer is achieved with a switching element which controls the valve unit when a predetermined operating pressure is exceeded.

While in the past different tool types were required for different operating pressure, the tool embodying the present invention can be employed over the entire operating pressure range for pneumatic nailers. A pneumatic nailer will always operate with optimum efficiency, that is in the low pressure range of about 3 to 5 bars, where the air compressed by the forward movement of the drive piston is supplemented with compressed air from the operating supply affording the very rapid return of the piston and a corresponding short cycle time. With a short operating cycle it is possible to obtain a high nail-setting frequency, that is, a high number of nails driven per unit of time. At a higher operating pressure, such as in the range of about 8 bar, the additional supply of compressed air from the operating supply for the return of the piston is unnecessary and would result in a high loss of compressed air. With the switching element embodying the present invention, the valve unit which affords an additional supply of compressed air into the storage chamber cuts off the additional supply when a predetermined operating pressure is exceeded. The control of the valve unit can be effected in various ways. One possibility is to block the valve unit using a disengageable stop.

The switching element may be designed in different ways. In one preferred embodiment, the switching element is formed as a pressure limiting valve. The pressure limiting valve checks the operating pressure. When the operating pressure exceeds a predetermined value, the position of the valve is changed. In most instances, the change in position of the valve results in blocking the flow of the operating compressed air to the valve unit. When the operating pressure drops below the predetermined value, the pressure limiting valve opens the flow of the compressed air and permits the flow through the valve unit to the storage chamber.

The switching element may be positioned at different locations. It is especially advantageous, however, to locate the switching element in the compressed air supply line leading to the valve unit. In such an arrangement, the operating pressure actually available at the valve unit is checked. Any changes in the operating pressure affecting the valve unit are taken into account.

The switching element can control the position of the valve unit in different ways. In one arrangement, the switching element can cut off the supply of compressed air from the valve unit to the storage chamber. For a simpler design, however, it is desirable to use the compressed air flowing through the switching element for positioning the valve unit. When the switching element changes position the supply of compressed air to the valve unit can be cut off. When the predetermined operating pressure is exceeded, the valve unit is shut down. Such operation avoids wear on the movable parts and on the packings or seals.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

The drawing is a somewhat schematic sectional view of a pneumatic nailer embodying the present invention.

DETAILED DESCRIPTION OF THE INVENTION

In the drawing an axially extending working cylinder 1, open at its opposite ends, supports a displaceable drive piston 2. The drive piston includes an axially elongated plunger 3 extending downwardly from a head 4, as viewed in the drawing. The head 4 is sealed within the cylinder. As illustrated, when driving a nail, the drive piston 2 moves from the position shown downwardly toward the lower end of the working cylinder 1. Accordingly, in the driving direction, the lower end of the cylinder is the leading end and the upper end is the trailing end. Working cylinder 1 is rigidly mounted within a casing 5 and is secured in the axial direction, that is, the driving direction, by a base 6 secured to the housing 5. At its trailing end, the cylinder is secured within a supporting ring 7 and the ring has an annular shoulder which rests against a cap 8 mounted in the upper end of the housing 5. Mounted within the cap 8 is a valve disk 9 arranged to slide in the axial direction of the cylinder 1 and the drive piston 2. A compression spring 11 is positioned within the cap and biases the valve disk 9 against the trailing end of the working cylinder 1. At the lower or leading end of the working cylinder, a buffer 12 is mounted in the base 6 so that the plunger or piston rod 3 can pass through the buffer and through an opening in the base.

Flanged on the housing 5, adjacent the trailing end of the working cylinder 1, is a hollow grip member 13 containing a cavity 14 which serves to convey compressed air into the tool. A trigger 15 is slidably mounted in the grip member 13 and a spool valve 16, forming a pressure safety device, extends downwardly from the grip portion 13 toward the leading end of the nailer alongside the housing 5.

A valve unit 17 forms an integral part of the nailer, however, for reasons of simplification and illustration it is shown as a separate member. The valve unit 17 includes an axially displaceable control piston 18 mounted in a guide sleeve 19 open at the lower end and closed by a screw cover 21. The various packing rings shown in the drawing are not described in detail for reasons of simplification, such packing rings are well known in the art.

In the drawing the pneumatic nailer is displayed in its inoperative position, that is, in position ready to drive a nail into a workpiece or target material. The operating pressure present in the cavity 14 acts on the end face 22 of the valve disk 9 facing in the driving direction. The oppositely facing end face 23 of the valve disk is also under the operating pressure through a bore 24 in the trigger 15 and a connecting duct 25 extending from the bore to the space opening to the end face 23.

Another connecting duct 26 extends from the cavity 14 to the bore 27 in the valve unit 17, that is into the opposite end of the bore 27 from the cover 21. A switching element 20 is located in the connecting duct between the cavity 14 and the bore 27 in the valve unit 17.

An annular duct 28 is located within the housing 5 extending around the outside surface of the supporting ring 7. A connecting bore 29 extends radially inwardly through the supporting ring 7 from the annular duct 28 to an annular recess 31 located in the inner face of the supporting ring extending around the working cylinder 1 adjacent the trailing end of the cylinder. Another bore 32 opens from the annular recess 31 through the working cylinder 1 into the interior of the cylinder. Further, a connecting duct 33 extends between the receiving bore 27 in the valve unit 17 and the annular recess 31. The connecting duct 33 is located at the opposite end of the receiving bore 27 from the end where the connecting duct 26 enters the bore. Therefore, the operating pressure is also present in the end of the receiving bore 27 adjacent the cover 21. As viewed in the drawing, the lower end of the control piston 18 has a larger head 34 than its upper end so that the piston is held in the illustrated position by the operating pressure, that is, it is biased toward the opening of the duct 26 into the receiving bore 27. In this position, communication between the end of the duct 26 and the opening into another duct 35 is blocked by the control piston. The duct 35 extends from the valve unit 17 into the annular storage chamber 36 which encircles the working cylinder 36 and is formed between the inside surface of the housing 5 and the outside surface of the working cylinder. Storage chamber 1 is in communication through openings 37 with the interior of the working cylinder 1 and the openings 37 are located adjacent the leading end of the working cylinder.

To commence the nail driving operation, the pneumatic nailer is pressed against a workpiece or target material. When such pressing action takes place, the spool valve 16 extending forwardly from the base 6 moves inwardly in its receiving bore 38. A connecting duct 39 extends from the receiving bore 38 to the bore containing the trigger 15. As the spool valve moves inwardly its valve head 41 traverses the end of the connecting duct 39 so that the duct is open to the atmosphere through furrows or channels formed in the spool valve 16. Subsequently, by squeezing the trigger 15 the supply of compressed air through the bore 24 into the duct 25 is cut off and no longer acts on the trailing end face 23 of the valve disk 9. At the same time, the movement of the trigger connects the ducts 25 and 39. Since duct 39 is open to the atmosphere, the compressed air previously acting on the end face 23 of the valve disk 9 escapes to the atmosphere. At the same time, the leading end face 22 of the valve disk experiences the operating pressure and the valve disk lifts off the trailing end face of the piston head 4 against the force of spring 11. As the valve disk 9 moves into the cap 8, an outflow opening 42 within the cap is closed. As the valve disk 9 lifts off the trailing end face of the piston head 4, the operating pressure contacts the trailing end face causing the drive piston 2 to move in the driving direction for driving or setting a nail, not shown, until the leading end face of the piston head strikes against the buffer 12. In the drawing, the arrow shown in full lines indicates the driving direction while the arrow shown with dashed lines indicates the return direction of the drive piston 2.

During the working stroke, the air within the working chamber ahead of the leading end face of the head 4 is forced through the openings 37 into the annular storage chamber 36 so that the air within the storage chamber is compressed as the drive piston completes its working stroke. As the head 4 runs up against the buffer 12, the air compressed in the storage chamber 36 starts the return of the drive piston 2 toward the position shown in the drawing. By removing the leading end of the nailer from the workpiece, the operating pressure within the cavity 14 can, via connecting duct 40, move the valve head 41 of the spool valve 16 back into the inoperative position as shown in the drawing. With the trigger 15 still depressed, operating pressure enters the space between the cap 8 and the valve disk 9 passing through the connecting ducts 40, 39 and 25. The operating pressure acting on the trailing end face 23 returns the valve disk to the illustrated inoperative position supported by the compression spring 11. The space between the piston head 4 of the partially returned drive piston 2 and the valve disk 9 is vented through the outflow opening 42 in the cap 8 which has been uncovered by the movement of the valve disk 9. As a result, the pressure in the annular recess 31 in communication with the interior of the working cylinder via the bore 32 decreases. The corresponding decreased pressure is present in the receiving bore 27 through the duct 33 and acts on the piston head 34 and at the same time through the duct 26, the opposite end of the control piston 18 is under the tool operating pressure. Accordingly, the control piston is displaced downwardly toward the screw cover 21. With this displacement, the ducts 26 and 35 are interconnected through the upper end of the bore 27 and the operating compressed air flows through the duct 35 into the storage chamber 36 and then through the openings 37 into the interior of the working cylinder 1 ahead of the piston head 4 for effecting the return of the drive piston to the position shown in the drawing. When the piston 2 returns to the position shown in the drawing, the head 4 closes the bore 32 and the operating pressure again is present within the annular recess 31. Accordingly, the presence of the operating pressure is communicated through the duct 33 to the lower end of the bore 27 so that the valve unit returns to the illustrated position.

The switching element 20 includes a valve piston 45 mounted for axial displacement against the biasing action of a spring 44 located within the lower end of a guide bore 43 as viewed in the drawing. The upper end of the bore is closed by a screw cover 46. In the illustrated position, the connecting duct 26 is continued by an annular groove 47 formed in the valve piston 45. A duct or passageway 48 extending through the upper part of the valve piston 45 introduces the operating compressed air to the end face of the piston 45 adjacent to the cover 46. As a result, the operating pressure supplied through the duct 26 acts against the valve piston 45 counter to the force of the spring 44.

The switching element operates essentially as a pressure-limiting valve. As soon as the operating pressure predetermined by the spring constant and the initial tension of the spring is exceeded, the valve piston 45 is displaced downwardly against the spring 44, as viewed in the drawing. With this downward movement, the flow through the duct 26 is blocked and the supply of compressed air to the valve unit 17 is cut off. Therefore, the valve unit is no longer active and the operating compressed air can not flow through it into the storage chamber 36. As a result, the return of the drive piston 2 is provided solely by the partially compressed air forced into the storage chamber 36. Accordingly, compressed air losses, due to an additional supply of the operating compressed air, are avoided, since the supply of compressed air at higher operating pressures is unnecessary.

If for any reason, the operating pressure drops below the predetermined value, the valve piston 45 is returned to the position illustrated in the drawing by the spring 44. As a result, the compressed air flow through the duct 26 into the valve unit 17 and the valve unit resumes the operation described above.

While specific embodiments of the invention have been shown and described in detail to illustrate the application of the inventive principles, it will be understood that the invention may be embodied otherwise without departing from such principles.

We claim:

1. Pneumatic nailer using compressed air for drivihg nails comprises an axially extending closed working cylinder having a first end and a second end spaced apart in the axial direction, a drive piston slidably supported in said working cylinder for movement in a driving direction from the second end toward the first end of said working cylinder, means for forming a storage chamber, means forming a supply source for conveying compressed air into said working cylinder for driving said drive piston, said storage chamber being in communication with said working cylinder adjacent the first end thereof so that air compressed ahead of said drive piston as it moves in the driving direction toward said first end enters from said working cylinder into said storage chamber, duct means connecting said means forming a supply source to said storage chamber and said duct means forming an independent flow of the operating compressed air to said storage chamber from the flow supplied to said working cylinder for driving said drive piston, a valve unit located in said duct means between said supply source means and said storage chamber for controlling the flow of operating compressed air through said duct means from said supply source means into said storage chamber, and a switching element located in said duct means in the path of the operating compressed air flow to said valve unit and arranged to control the flow of operating compressed air to said valve unit so that when a predetermined operating compressed air pressure is exceeded flow of the operating compressed air to said valve unit is blocked by said switching element.

2. Pneumatic nailer, as set forth in claim 1, wherein said switching element is a pressure-limiting valve.

3. Pneumatic nailer, as set forth in claim 1 or 2, wherein said duct means comprises a compressed air supply line connected through said switching element to said valve unit for supplying operating compressed air thereto.

4. Pneumatic nailer, as set forth in claim 3, wherein means form a guide bore for said switching element and said switching element is displaceable within said guide bore for blocking the flow of compressed air through said compressed air supply line to said valve unit so that said valve unit can not supply the operating compressed air into said storage chamber when the predetermined operating pressure is exceeded.

5. Pneumatic nailer, as set forth in claim 1, wherein said means forming said storage chamber comprises an annular wall encircling said working cylinder and spaced radially outwardly from said working cylinder, a supporting ring for said working cylinder encircling the end part of said working cylinder adjacent the second end thereof, an annular recess in said supporting ring arranged during operation of said drive piston to be placed in communication with the interior of said working chamber adjacent the second end thereof, an annular groove formed in the radially outer surface of said supporting ring and a first duct extending through said supporting ring and communicating said anqular groove and said annular recess, a second duct connecting said annular recess and said valve unit, said annular groove being arranged to receive the operating compressed air within said nailer, said valve unit includes a bore and a piston slidably displaceably mounted in said bore, said second duct extending between said annular recess and said valve unit opens into one end of said bore in said valve unit, a third duct for supplying compressed air to said valve unit opens into the opposite end of said bore from said second duct communicating with said annular recess, and a fourth duct communicating with said bore in said valve unit and with said storage chamber, said piston within said bore in said valve unit being displaceable between a first position for blocking flow through said bore to said storage chamber and a second position for admitting the operating compressed air flowing through said switching unit into said valve unit and on to said storage chamber, and an axially displaceable spool valve mounted on said housing and extending axially from the first end of said working cylinder for controlling the operation of said nailer.

* * * * *